US006705358B1

(12) United States Patent
Tortorici, Jr. et al.

(10) Patent No.: US 6,705,358 B1
(45) Date of Patent: Mar. 16, 2004

(54) SYSTEM AND METHOD FOR DILUTING A SUPER-CONCENTRATED DETERGENT IN SITU AT CUSTOMER LOCATIONS

(75) Inventors: Paul Lee Tortorici, Jr., Houston, TX (US); Michael Joseph Doll, Katy, TX (US); Stephen P. Giles, Damon, TX (US); Kirk Herbert Raney, Houston, TX (US); Kim Colson Millspaugh, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/418,417

(22) Filed: Apr. 18, 2003

(51) Int. Cl.[7] ..... B65B 1/04; B65B 3/04

(52) U.S. Cl. ..... 141/9; 141/104; 141/105; 222/145.6; 68/17 R; 137/268

(58) Field of Search ..... 141/2, 9, 18, 21, 141/104, 105; 222/145.6; 68/17 R; 137/268; 118/683, 684

(56) References Cited

U.S. PATENT DOCUMENTS

| | | | | |
|---|---|---|---|---|
| 4,324,494 A | 4/1982 | Pryor et al. | ..... | 366/156 |
| 5,014,211 A | 5/1991 | Turner et al. | ..... | 364/478 |
| 5,020,917 A | 6/1991 | Homan | ..... | 366/161 |
| 5,322,222 A | 6/1994 | Lott | ..... | 239/403 |
| 5,584,327 A | 12/1996 | Thomas et al. | ..... | 141/104 |
| 5,664,733 A | 9/1997 | Lott | ..... | 239/429 |
| 5,870,906 A | 2/1999 | Denisar | ..... | 68/17 R |
| 5,992,763 A | 11/1999 | Smith et al. | ..... | 239/428.5 |
| 6,000,839 A | 12/1999 | Lott | ..... | 366/181.5 |
| 6,395,091 B1 * | 5/2002 | Jefferson et al. | ..... | 118/683 |

* cited by examiner

*Primary Examiner*—Timothy L. Maust

(57) ABSTRACT

A solution to the problem of reducing the bulk and weight of detergents for delivery to users by providing in at least one embodiment an in situ, discrete, batch mixing method and system for a diluent and concentrated detergent at a point of dispense. While some systems are designed to mix diluents and detergents, those systems are typically designed for continuous flow, for example, in a manufacturing facility. The present invention provides for mixing the diluent and detergents in discrete batches sized for a user at the point of dispense, using a method and system that can be located even in remote areas without an external power supply. The system and method only needs diluent line pressure in at least one embodiment. Further, the method and system controls access to the batch quantity so that multiple batches are not unintentionally extracted. The method and system can be used with vending machines placed on site.

20 Claims, 3 Drawing Sheets

SYSTEM AND METHOD FOR DILUTING A SUPER-CONCENTRATED DETERGENT IN SITU AT CUSTOMER LOCATIONS

FIELD OF THE INVENTION

This invention relates to dilution systems and methods for concentrated detergents. More specifically, the invention relates to a system and method for dilution of a concentrated detergent independent of external power.

BACKGROUND OF THE INVENTION

Typical liquid detergents are purchased in diluted, ready-to-use form. The practice is convenient and customary for typical users. However, a significant portion of the purchase price of the ready-to-use detergent is due to the costs of the packaging, storage and shipping weight. The resulting costs become problematic as the distance increases from the manufacturing facility to a point of use.

Servicing remote areas are especially problematic. For example, the expense of transporting the bulk and weight of ready-to-use detergents to third world countries is sometimes prohibitive, especially when the standard of living is lower than the country from which the goods are manufactured. One solution is to manufacture the goods in the particular country. This option is often prohibitive in itself due to the costs of creating a manufacturing facility of tens or hundreds of millions of dollars. Even if the manufacturing is done in an industrial area in that country, transporting the ready-to-use detergents to remote areas of the particular country can still be expensive.

Therefore, there remains a need to supply ready-to-use detergents that minimizes the bulk and weight to the user, but also allows transporting the detergent in a concentrated form to avoid the shipment of large quantities of water.

SUMMARY OF THE INVENTION

The present invention provides a solution to the problem of reducing the bulk and weight of detergents for delivery to users by providing in at least one embodiment an in situ, discrete, batch mixing method and system for a diluent and concentrated detergent at a point of dispense. While some systems are designed to mix diluents and detergents, those systems are typically designed for continuous flow, for example, in a manufacturing facility. The present invention provides for mixing the diluent and detergents in discrete batches sized for a user at the point of dispense, using a method and system that can be located even in remote areas without an external power supply. The system and method only needs diluent line pressure in at least one embodiment. Further, the method and system controls access to the batch quantity so that multiple batches are not unintentionally extracted. The method and system can be used with vending machines placed on site.

The present invention provides in at least one embodiment a batch quantity system with a filling machine for mixing and dispensing a super concentrated detergent with a diluent, comprising a diluent supply having a line pressure; a detergent container containing concentrated detergent to form a detergent supply; a control valve adapted to control a flow of a batch quantity of the diluent supply, the concentrated detergent, or a combination thereof, the valve operated independent of an external power supply; an eductor coupled to the diluent supply and the concentrated detergent supply and adapted to receive the pressurized diluent and cause a corresponding flow of the concentrated detergent to form a combined flow of the diluent and the detergent; a static inline mixer coupled to the eductor to mix the combined diluent and detergent; a fill container disposed downstream of the eductor to receive a predetermined quantity of the combined diluent and detergent; and an outlet of the fill container adapted to flow the combined diluent and detergent into a removable container.

The present invention also provides in at least one embodiment a method for mixing and dispensing a batch quantity of super concentrated detergent with a diluent, comprising providing a diluent at a pressure to create a diluent supply; providing a detergent container containing concentrated detergent to create a detergent supply; coupling a flow of each of the diluent supply and detergent supply to an eductor; flowing a quantity of the diluent and the detergent through the eductor to create a combined flow of diluent and detergent; flowing the combined flow through a static inline mixer; flowing the combined flow into a fill container to create a predetermined quantity of the combined diluent and detergent; stopping the combined flow of the diluent supply and detergent supply into the fill container; and dispensing an output of the combined flow.

The present invention also provides a batch quantity system with a filling machine for mixing and dispensing a super concentrated detergent with a diluent, comprising a diluent supply having a line pressure; a detergent container containing concentrated detergent to form a detergent supply; a control valve adapted to control a flow of a batch quantity of the diluent supply, the concentrated detergent supply, or a combination thereof, the valve operated independent of an external power supply; an eductor coupled to the diluent supply and the detergent supply and disposed downstream of the control valve, the eductor adapted to receive the pressurized diluent and cause a corresponding flow of the concentrated detergent to form a combined flow of the diluent and the detergent; a static inline mixer coupled to the eductor to mix the combined diluent and detergent; a fill container disposed downstream of the eductor and adapted to receive a predetermined quantity of the combined diluent and detergent based on an automatic operation of the control valve and on a predetermined level of diluent and detergent in the fill container; an outlet of the fill container adapted to flow the combined diluent and detergent into a removable container; and an outlet valve coupled to the outlet and adapted to remain open after actuation until a quantity of the combined diluent and detergent flows out of the fill container and to automatically close after the quantity has flowed out.

BRIEF DESCRIPTION OF THE DRAWINGS

A more particular description of the invention, briefly summarized above, may be realized by reference to the embodiments thereof that are illustrated in the appended drawings and described herein. However, it is to be noted that the appended drawings illustrate only some embodiments of the invention. Therefore, the drawings are not to be considered limiting of its scope, for the invention may admit to other equally effective embodiments.

DETAILED DESCRIPTION OF THE INVENTION

Figure 1:
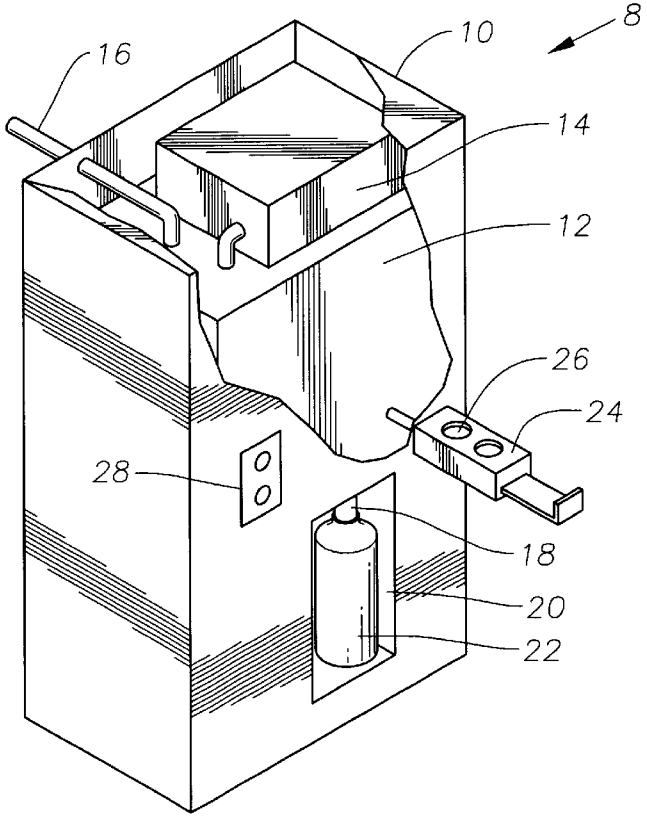
FIG. 1 is a schematic perspective view of a discrete batch quantity system with a filling machine.

FIG. 1 is a schematic perspective view of a discrete batch quantity system with a filling machine. In general, the batch quantity system 8 includes various internal and external elements, such as a filling machine 10 having a fill container 12 with a detergent container 14 coupled to the fill container 12 and various controls. The filling machine dispenses product in response to one or more selections that are input into the machine by a user. The filling machine 10 can be provided in the form of a "vending machine." In this application, the term "vending machine" is meant to include a filling machine that can be operated by coin, token, card, or other suitable means of compensation or control.

The filling machine 10 can be disposed at a location that is accessible to a user and can mix the diluent and detergent on site at the point of dispense, that is in situ, to the user. As described below, the filling machine 10 can operate independent from an external power supply. Thus, the filling machine 10 can be located at remote sites that may not be supplied with such external power supply, that is, without electrical, solar, pneumatic, nuclear, or other common power sources. An "external power supply" does not include use of manual power such as from a human, line pressure from a diluent supply, or gravity, described below.

In addition to the detergent container 14, the system 8 includes a diluent supply 16 fluidicly coupled to the fill container 12 with an outlet 18 coupled thereto. The outlet 18 is adapted to allow a quantity of the diluent and detergent mixture to exit the fill container 12. The outlet 18 can dispense the mixture into a removable container 22, such as provided by the filling machine or by a user. Advantageously, an opening 20 can be provided for the convenience of the user to insert the removable container 22, if desired. The internal and external structures that are associated with the filling machine 10 in at least some embodiments are described in reference to FIGS. 2–4.

The system 8 can also include a start controller 24 which in at least one embodiment is a manually operated mechanical device. This feature further allows the system to operate independent of an external power supply. In other embodiments, the start controller 24 can be operated by a diversion of the diluent supply 16 with its line pressure and a switch (not shown) to control the start controller. The start controller 24 is coupled to various elements within the system 8, to be described below that actuate the system. One or more compensation elements 26, such as coins, tokens, cards, and other numismatic or control items can be used in connection with the start controller 24 to control the access and output of the mixture through the outlet 18. Further, a selector controller 28 can be used to select various additives or other features in the combination of the diluent and the concentrated detergent.

Advantageously, the shipment of the detergent container 14 containing concentrated detergent reduces the bulk, weight, and therefore expense, of transporting diluted packaged liquid detergent to various locations, including remote areas. In at least one embodiment, the line pressure from the diluent supply 16, controlled by manual actuation and supplemented by gravity, is the primary way to uniquely combine the flows into a relatively homogeneous mixture. Thus, the cost can be reduced in supplying ready-to-use detergent to the user with minimal external needs.

Figure 2:
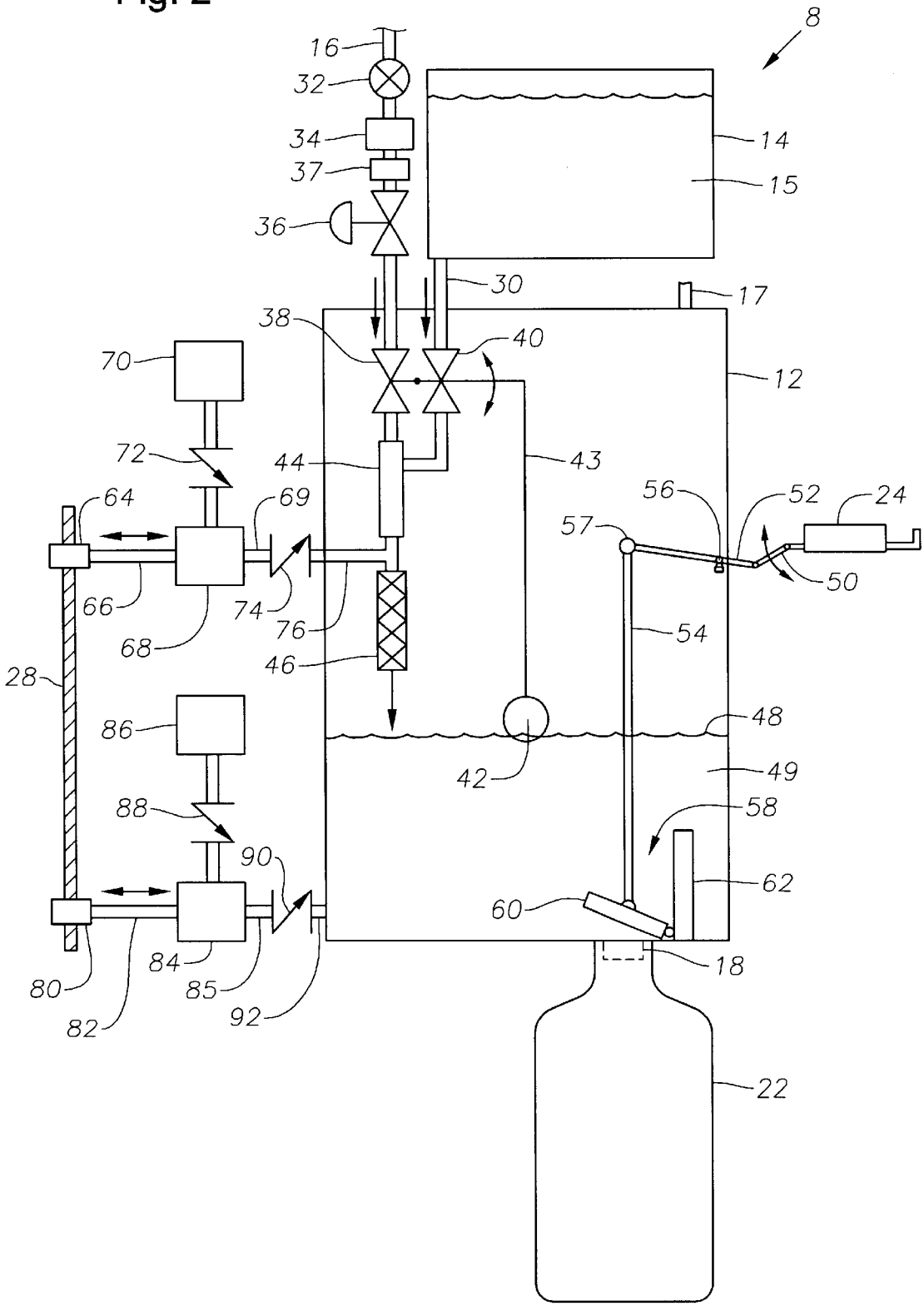
FIG. 2 is a schematic cross-sectional view of the discrete batch quantity system.

FIG. 2 is a schematic cross-sectional view of the discrete batch quantity system 8. As described above, the system can include a fill container 12, a detergent container 14 coupled thereto, and a diluent supply also coupled to the fill container 12. The fill container 12 includes an outlet 18 disposed at an appropriate location on the fill container, so that a removable container 22 can receive a batch quantity of combined diluent and detergent. The term "coupled," "coupling," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include integrally forming one functional member with another. The coupling can occur in any direction, including rotationally.

The detergent container 14 generally includes a quantity of concentrate detergent 15. The concentrated detergent can be a variety of formulations as may be suitable to the particular conditions in which the system is operated. For example, some formulations may be more suitable to colder climates. Without limitation, examples include mixtures containing a commercially available surfactant known as Neodol™ N45-7, commercial laundry detergents, generally in liquid form with low water content, and other formulations. Further, the detergents can include short chain alcohols and glycols, whitening agents, enzymes, and other components as should be known to those with ordinary skill in the art in the detergent field. Some formulations have gelling problems that are particularly associated with water mixed with detergent having high levels of surfactants. The embodiments described herein generally combine the diluent and detergent using an eductor and/or mixer to reduce the gelling problems.

The diluent supply 16, generally water, can be provided at a given line pressure. The line pressure can vary from location to location. In at least one embodiment, it is believed that 30 pounds per square inch at gage (psig) can be used, although other line pressures, smaller and greater, can be used. The diluent supply 16 can include associated elements, such as a valve 32, filter 34, UV lamp 37 for disinfection, and pressure regulator 36, known to those with ordinary skill in the art. For example, if the diluent supply is provided at 30 psig, the pressure regulated can reduce the pressure to 10 psig, for example and without limitation, and provide satisfactory mixing in at least one embodiment.

Similarly, the detergent container 14 can provide a detergent through a detergent supply 30 to the fill container 12. The flow path between the detergent container 14 and the fill container 12 can also include similar elements as can be required for given installations, such as valves and filters (not shown). In general, the line pressure of the diluent supply 16 will be greater than the detergent supply 30 pressure, because generally the detergent supply will be operated by gravity in close proximity to the fill container 12. Further, in other embodiments, the detergent container 14 can be located on level or below level of the fill container 12, since the eductor described below creates a siphoning effect. It is anticipated that the detergent container 14 will be removably coupled to the fill container 12 as the detergent is replenished. Thus, it can be advantageous to include quick disconnect fittings and other appropriate elements between the detergent container 14 and the fill container 12.

The diluent supply 16 and the detergent supply 30 from the detergent container 14 can be coupled to one or more control valves to control the respective flows into the fill container 12. For example, the diluent supply 16 can be coupled to a control valve 38 and the detergent supply 30 can be coupled to a control valve 40. However, it is to be understood that the control valves can function in unison and even be incorporated physically into a single unit. Still further, it can be useful to only control the flow of one of the fluids, while the other fluid responds to the first fluid flow. For example, the diluent supply can be controlled through the control valve and the detergent supply can respond to the diluent flow without a control valve for the detergent. Thus, the term "control valve" herein can include one or more valve units that control the diluent supply, the detergent supply, or a combination thereof.

One or more of the control valves can be selectively operated by an external input. In at least one embodiment, the external signal can be caused by a valve controller 42, such as a float, that actuates a linkage 43, to open and close the control valves 38, 40. The combined diluent and detergent 49 in the fill container 12 establishes a fluid level 48 at any given time. When the fluid level 48 rises to a predetermined level in the fill container 12, the valve controller 42 rises to a point that shuts off one or more of the control valves 38, 40. For example, the control valves can operate to place a restriction over a seat (not shown) in the control valves.

An eductor 44 can be disposed in the system 8 downstream of the control valves 38, 40 in at least one embodiment. The eductor allows diluent, such as water, to act as a siphoning mechanism to pull and entrain a dosage of detergent concentrate with the flow of diluent through an internal eductor cavity. The flow of diluent through the eductor causes a pressure drop as the fluid is forced through a venturi inside the eductor. The suction of the diluent siphons a dosage of detergent with each movement of the diluent through the venturi. The diluent's constant flow and suction allows a detergent concentrate to be dosed relatively rapidly and generally in a constant ratio of diluent-to-detergent, based on the diluent pressure and line restrictions.

Without limitation, eductors can be purchased from Fox Valve from Glover, N.J. in the United States. For example, a Fox liquid jet eductor part no. ½" 121-WJE-CS has been found to provide 2.5 gallons per minute of water at 30 psig and 700° Fahrenheit to create a suction of up to 6 gallons per minute of detergent having a specific gravity of 1.1 at 0 psig and 70° Fahrenheit where the discharge was at 0.25 psig. It is to be understood that other eductors, other sizes, and other pressures are contemplated by the present invention and the above description is only exemplary.

Thus, in the embodiment shown, the diluent supply can be provided to one portion of the eductor and the detergent from the detergent supply provided to a second portion of the eductor. When the control valve 38 operates to allow the diluent to flow therethrough, the diluent also can flow through the eductor 44. When the detergent supply is allowed to flow through the control valve 40 and into the eductor 44, a generally consistent combination of diluent and detergent can exit therefrom.

One of the challenges in this art is a proper combination of the diluent and concentrate to avoid gelling and viscosity issues. To ensure a commercially satisfactory product, a static mixer 46 is generally included in the system 8 downstream of the eductor 44. Generally, a static mixer does not require an external power supply to turn rotors and other movable parts. In some embodiments, static mixers use a stationary spiral winding. The diluent and detergent flow through the static mixer, and the winding causes a turbulent flow under force that relatively quickly breaks up the detergent concentrate gel into smaller particles which can rapidly dissolve in the diluent. Flow through the static mixer 46 can enter the fill container 12 and continue until a predetermined level is obtained, at which time one or more of the control valves 38, 40 are closed.

It is to be understood that the sequence of the control valve(s), eductor, and mixer can be varied. For example, and without limitation, the control valve(s) can be located downstream of either the eductor 44 or the mixer 46, so that flow through the eductor and mixer generally occurs when the valves are open.

Figure 3:
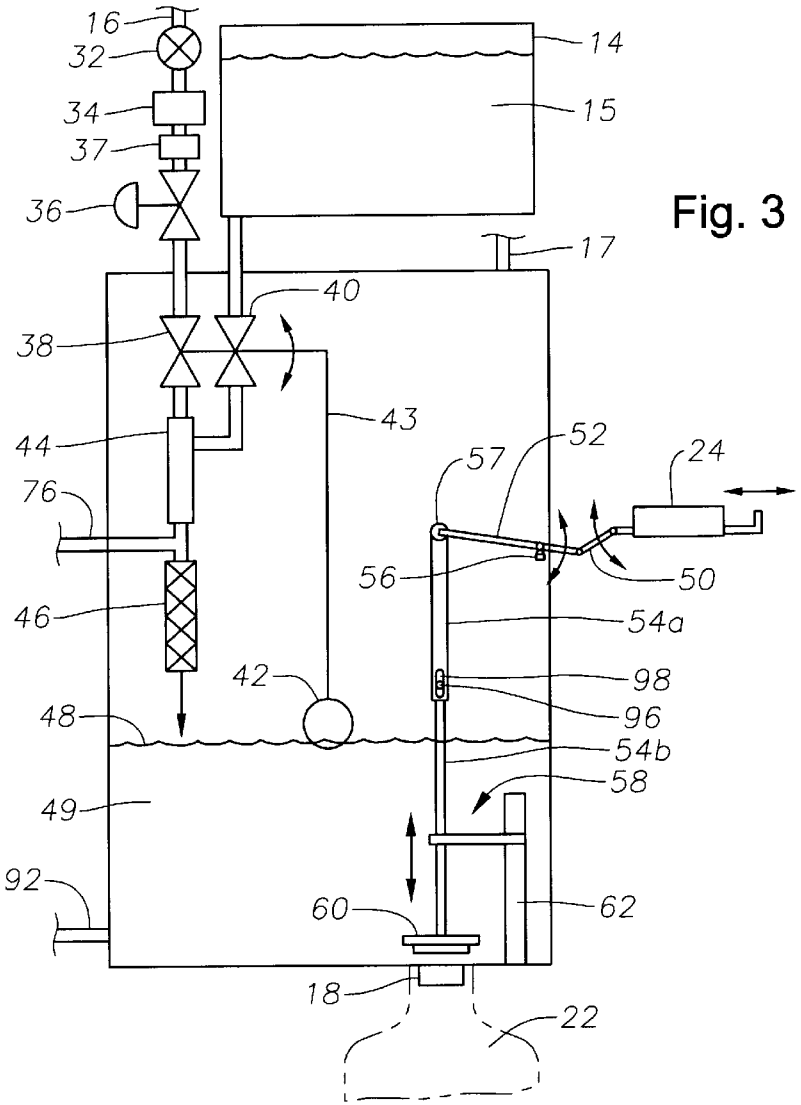
FIG. 3 is a schematic cross-sectional view of another embodiment of the system.
Figure 4:
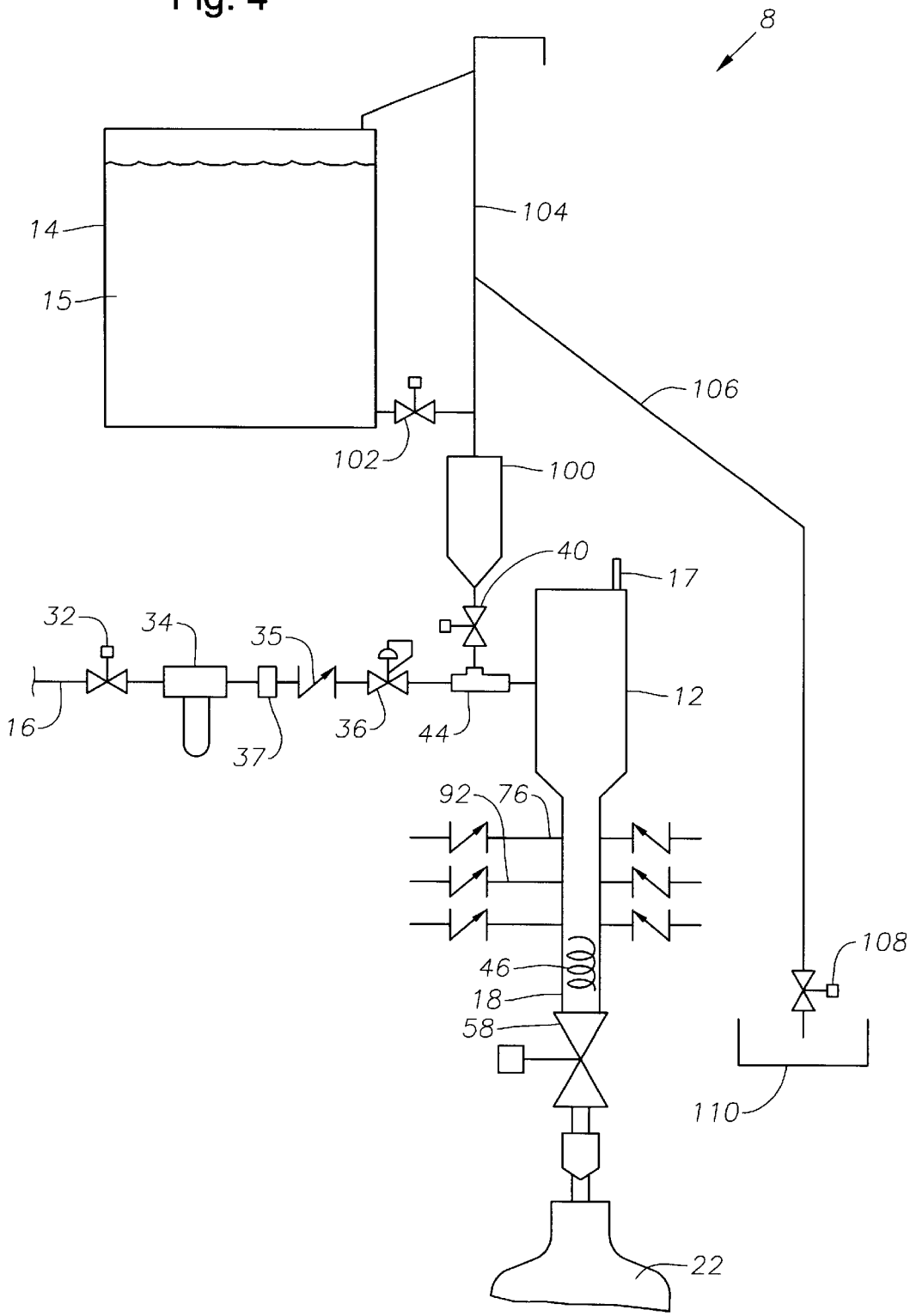
FIG. 4 is a schematic diagram of another embodiment of the system.

The combined flow of diluent and detergent can be dispensed though the outlet 18, described above. Some exemplary embodiments that can be used to dispense the diluent and detergent are shown in FIGS. 2–4. For example, in FIG. 2, the start controller 24 can be used to actuate the dispensing and can be manually operated. One or more linkages 50, 52, 54 and one or more pivot points 56, 57, as appropriate, couple the start controller 24 to an outlet valve 58. The outlet valve 58 in the embodiment is disposed within the fill container 12. However, it is to be understood that the outlet valve could be disposed external to the fill container 12.

The outlet valve 58 can include a valve element 60 that can be raised and lowered in the fill container 12. Advantageously, the outlet valve 58 can remain automatically open after actuation until a quantity of the combined diluent and detergent flows out of the container, independent of further actuation by the start controller 24. The valve element 60 can automatically close after the quantity has flowed out of the fill container. In one embodiment, the valve element can include a flapper that would raise and remain in a raised position through flotation or other means until a quantity of the combined diluent and detergent flows out. The valve element 60 can be coupled, such as hingeably attached, to a support structure 62, such as a post.

To further illustrate the actuation, a compensation element 26, described in reference to FIG. 1, can be inserted into the start controller 24. The start controller 24 can be manually actuated to move the linkages 50, 52 and 54. At least one of the linkages 50, 52, 54 raises the valve element 60 away from a sealing engagement with the outlet 18. This action allows a quantity of the combined diluent and detergent to flow out of the outlet 18 and into the removable container 22. The level 48 lowers in the fill container 12 until the valve element 60 can reseat itself on the outlet 18. In the meantime, the start controller 24 can be reset independent of the status of the valve element 60. Thus, it is advantageous for one or more of the linkages 50, 52, or 54 to be flexible or otherwise movable relative to the valve element 60, so that the valve element 60 and the start controller 24 can be operated independently.

Optionally, additives can be supplemented to the diluent, detergent, or a combination thereof. Additives can include whiteners, fragrances, dyes, and other additional components. In some embodiments, it may be advantageous to include the additive in the flow stream prior to the static mixer 46. In other embodiments, it can be suitable to supplement the additive into the combined flow after the static mixer, such as with additives that can rapidly disperse through an existing part of the fluid. Other places of supplementing the additives can also be determined depending on the particular application. In the embodiment shown, two separate lines are included, where one is added upstream of the static mixer 46 and the other downstream, although other positions and other quantities of lines could be used.

A selective controller 28, also shown in FIG. 1, can be used to control the addition of the additives. For example, an additive actuator 64 can be actuated at a user's discretion to add certain additives. In one example, the additive actuator can include a push-button that traverses in or out from the selector controller 28. Levers, toggles, and other actuators, known to those with ordinary skill in the art could be used. The additive actuators 64 can be coupled to a linkage 66 that is coupled to a dosing chamber 68. For example and without limitation, the dosing chamber 68 can be an injector, a syringe, or other manual pump element. Advantageously, in consonance with other parts of system 8, the dosing chamber 68 can be manually operated independent of an external power supply. An additive container 70 is coupled to the dosing chamber 68. A one-way valve 72, such as a check valve, can be disposed between the additive container 70 and the dosing chamber 68. Alternatively, the one-way valve 72 can be incorporated into the additive container 70 or the dosing chamber 68. Thus, when the dosing chamber 68 is actuated, the fluid contained in the dosing chamber is forced to go through an outlet 69 as opposed to returning through the inlet to the additive container 70. The outlet 69 of the dosing chamber 68 can be coupled to a one-way valve 74 and in turn coupled to a conduit 76. The conduit 76 can be coupled to the flow path of the diluent, detergent, or combined diluent and detergent.

A similar arrangement can be made for another additive. For example, an additive actuator 80 can be coupled to a linkage 82, a dosing chamber 84, and similarly to a second additive container 86. The second additive container 86 can flow an additive through a one-way valve 88 into an inlet of the dosing chamber 84. The dosing chamber 84 can pump a quantity of the additive through a one-way valve 90 into a conduit 92 and into the fill container 12. Although not shown, it is to be understood that multiple additive containers can be included on one dosing chamber. If desired, the user can select between various additives by selective switches, diverter valves, and other selection means, known to those with ordinary skill in the art for such elements.

FIG. 3 is a schematic cross-sectional view of another embodiment of the system 8. Similar elements are similarly numbered as described above. For example, the system 8 generally includes the fill container 12 coupled to a detergent container 14 and a diluent supply 16. One or both of the diluent supply and detergent supply from the detergent container 14 can be controlled through one or more control valves 38, 40. The diluent and detergent can be combined by an eductor 44 and flow through a static mixer 48 to provide satisfactory mixing. Additives can be injected into one or more conduits 76, 92 coupled to the fill container 12 or other portions of the system, as appropriate. The combined diluent and detergent can flow out of the fill container through the outlet 18 and into a removal container 22.

An outlet valve 58 can control the dispensing of the combined diluent and detergent through the outlet 18, similar to the outlet valve 58 described in reference to FIG. 2. The outlet valve 58 includes a valve element 60 that can be translated axially comparing to rotatably, as previously above. The start controller 24 can actuate one or more linkages 50, 52, and 54 and one or more pivot points 56, 57. The linkage 54 can be comprised of multiple elements, such as linkages 54*a* and 54*b*. The linkages 54*a* and 54*b* may be slidably engaged with each other through a pin 96 and a slot 98 arrangement. For example, the slot can be formed in linkage 54*a*, and the pin 96 can be coupled to linkage 54*b*. The length of the linkage 54*a*, 54*b* can allow the pin to be disposed in the bottom portion of the slot 98 in an initially closed position of the valve 58. When the linkage 54*a* is lifted by actuation of the start controller 24, the linkage 54*a* can pull upward the linkage 54*b*. The movement can axially pull up the flapper element 60 of the valve 58 away from sealing engagement with the outlet 18. The flapper element 60 can remain disengaged from the outlet 18 to allow the combined diluent and detergent 49 to flow through the outlet 18 into the removable container 22. While the flapper element 60 is disengaged, the linkage 54*a* can be returned to a reset position, that is, lowered in the orientation shown in FIG. 3. The lowering of the linkage 54*a* is independent of the position of the linkage 54*b* and the valve element 60 by allowing the pin 96 to slide in the slot 98. A support structure 62 can be slidably coupled to the linkage 54*b* and the valve element 60 to provide lateral stability, if desired.

FIG. 4 is a schematic diagram of another embodiment of the system 8. Similar elements are similarly labeled as described above and referenced in FIGS. 1–3. In this embodiment, some of the elements described above are external to the fill container 12. For example, the detergent container 14 which includes a quantity of concentrated detergent 15, is coupled to the eductor 44 external to the fill container 12. Similarly, the diluent supply 16 is coupled to the eductor 44 also external to the fill container 12. The fill container 12 can receive the combined flow of diluent and detergent from the eductor 44 to establish a predetermined quantity of combined diluent and detergent. In at least one embodiment, the predetermined quantity can be limited by the quantity that can flow into the fill container 12. For example, a fill container 12 can be coupled to valve 17 that can function as an air release in combination with a fluid one-way valve, known to those with ordinary skill in the art for fluid systems. The valve 17 can allow air to enter and exit the fill container 12. However, when the fluid rises to a certain level and seeks to exit the valve 17, an internal float floats up to a seat to restrict the exit of the fluid. Thus, only a fixed quantity of the combined diluent and detergent can flow at any given time into the fill container 12 before the fill container is filled.

Further, the diluent supply 16 in an exemplary embodiment can be coupled to a valve 32, a filter 34, UV lamp 37, a one-way valve 35, a pressure regulator 36, and the eductor 44. In this embodiment, the valve 32 can function as a control valve 38, described in reference to FIGS. 2 and 3. The valve 32 can be manually actuated in at least one embodiment.

The detergent container 14 can be used to flow detergent through a valve 102 into a prefill container 100. The prefill container 100 provides a measured quantity of detergent prior to entrance into the eductor 44. Further, valve 40 can be disposed downstream of the prefill container to act as a control valve for the entrance of the detergent into the eductor 44. In at least one embodiment, the control valve 40 can be manually actuated.

A vent 104 can be coupled to either the detergent container 14, the prefill container 100, or both. The vent 104 can also be coupled to a drain line 106. A valve 108 can be used to control the draining of the drain line 106 into the container 110. Similar to the embodiment described above, one or more conduits 76, 92 can be used to provide additives into the diluent, detergent, or both. In the embodiment shown, the diluent and detergent are combined through the eductor into the fill container 12 and the additives are provided subsequent thereto. Further, all the fluids are present prior to flowing through the static inline mixer 46. The outlet of the combined diluent and detergent is controlled by outlet valve 58. The outlet valve 58 can also be manually actuated in at least one embodiment. As would be understood to those with ordinary skill in the art given the disclosure contained herein, variations of the sequence of elements and combining of fluids can be made as appropriate to the particular substances and mixture homogeneity.

While the foregoing is directed to various embodiments of the present invention, other and further embodiments may be devised without departing from the basic scope thereof. For example, the various methods and embodiments of the invention can be included in combination with each other to produce variations of the disclosed methods and embodiments, as would be understood by those with ordinary skill in the art, given the teachings described herein. Also, a plurality of the embodiments could be used in conjunction with each other for a given application. Also, the directions such as "top," "bottom," "left, " "right," "upper," "lower," and other directions and orientations are described herein for clarity in reference to the figures and are not to be limiting of the actual device or system or use of the device or system. The device or system may be used in a number of directions and orientations. Further, the order of steps can occur in a variety of sequences unless otherwise specifically limited. The various steps described herein can be combined with other steps, interlineated with the stated steps, and/or split into multiple steps. Additionally, the headings herein are for the convenience of the reader and are not intended to limit the scope of the invention.

Further, any references mentioned in the application for this patent as well as all references listed in the information disclosure originally filed with the application are hereby incorporated by reference in their entirety to the extent such may be deemed essential to support the enabling of the invention(s). However, to the extent statements might be considered inconsistent with the patenting of the invention (s), such statements are expressly not meant to be considered as made by the Applicants.

We claim:

1. A batch quantity system with a filling machine for mixing and dispensing a super concentrated detergent with a diluent, comprising:

a. a diluent supply having a line pressure;

b. a detergent container containing concentrated detergent to form a detergent supply;

c. at least one control valve adapted to control a flow of a batch quantity of the diluent supply, the concentrated detergent, or a combination thereof, the valve operated independent of an external power supply;

d. an eductor coupled to the diluent supply and the concentrated detergent supply and adapted to receive the pressurized diluent and cause a corresponding flow of the concentrated detergent to form a combined flow of the diluent and the detergent;

e. a static inline mixer coupled to the eductor to mix the combined diluent and detergent;

f. a fill container disposed downstream of the eductor to receive a predetermined quantity of the combined diluent and detergent; and g. an outlet of the fill container adapted to flow the combined diluent and detergent into a removable container.

2. The batch system of claim 1, wherein the batch quantity system comprises a vending machine through which the combined diluent and detergent is dispensed.

3. The batch system of claim 1, further comprising an outlet valve coupled to the outlet and adapted to remain open after actuation until a quantity of the combined diluent and detergent flows out of the fill container and to automatically close after the quantity has flowed out.

4. The batch system of claim 3, further comprising a manually operated start controller adapted to actuate the outlet valve independent of a power source and allow the outlet valve to remain open until the quantity of the combined diluent and detergent flows out of the fill container.

5. The system of claim 3, wherein the automatic closure of the outlet valve is independent of the actuation by the start controller.

6. The batch system of claim 1, further comprising at least one injection line coupled to the diluent supply, detergent supply, or a combination thereof and adapted to supply at least one additive to the diluent and detergent.

7. The batch system of claim 1, wherein the control valve operates the diluent supply.

8. The batch system of claim 1, wherein the control valve operates both the diluent supply and the detergent supply.

9. The batch system of claim 1, wherein independent of an external power supply comprises independent of electrical, pneumatic, solar, and nuclear power.

10. A method for combining and dispensing a batch quantity of super concentrated detergent with a diluent, comprising:

a. providing a diluent at a pressure to create a diluent supply;

b. providing a detergent container containing concentrated detergent to create a detergent supply;

c. coupling a flow of each of the diluent supply and detergent supply to an eductor;

d. flowing a quantity of the diluent and the detergent through the eductor to create a combined flow of diluent and detergent;

e. flowing the combined flow through a static inline mixer;

f. flowing the combined flow into a fill container to create a predetermined quantity of the combined diluent and detergent;

g. stopping the combined flow of the diluent supply and detergent supply into the fill container; and h. dispensing an output of the combined flow.

11. The method of claim 10, wherein the combining and dispensing occurs with a vending machine.

12. The method of claim 10, wherein stopping the combined flow of the diluent supply and detergent supply comprises operating a control valve automatically based on a level of diluent and detergent in the container.

13. The method of claim 10, wherein controlling an output of the combined flow comprises operating an outlet valve coupled to the outlet that remains open after actuation of the outlet valve until a quantity of the combined diluent and detergent flows out of the fill container and automatically closing the outlet valve after the quantity has flowed out.

14. The method of claim 13, wherein operating an outlet valve to automatically close after the quantity has flowed out comprises operating independent of the actuation by the start controller.

15. The method of claim 10, wherein the flowing of the detergent supply and the combined flow occur independent of an external power supply.

16. A batch quantity system with a filling machine for mixing and dispensing a super concentrated detergent with a diluent, comprising:

a. a diluent supply having a line pressure;

b. a detergent container containing concentrated detergent to form a detergent supply;

c. at least one control valve adapted to control a flow of a batch quantity of the diluent supply, the concentrated detergent supply, or a combination thereof, the valve operated independent of an external power supply;

d. an eductor coupled to the diluent supply and the detergent supply and disposed downstream of the control valve, the eductor adapted to receive the pressurized diluent and cause a corresponding flow of the concentrated detergent to form a combined flow of the diluent and the detergent;

e. a static inline mixer coupled to the eductor to mix the combined diluent and detergent;

f. a fill container disposed downstream of the eductor and adapted to receive a predetermined quantity of the combined diluent and detergent based on an automatic operation of the control valve and on a predetermined level of diluent and detergent in the fill container;

g. an outlet of the fill container adapted to flow the combined diluent and detergent into a removable container; and h. an outlet valve coupled to the outlet and adapted to remain open after actuation until a quantity of the combined diluent and detergent flows out of the fill container and to automatically close after the quantity has flowed out.

17. The batch system of claim 16, wherein the batch quantity system comprises a vending machine through which the combined diluent and detergent is dispensed.

18. The system of claim 16, further comprising a manually operated start controller adapted to actuate the outlet valve independent of a power source and allow the outlet valve to remain open until the quantity of the combined diluent and detergent flows out of the fill container.

19. The system of claim 16, wherein the detergent flow is provided by gravity to the eductor.

20. The system of claim 16, wherein the automatic closure of the outlet valve is independent of the actuation by the start controller.

* * * * *